US006016784A

United States Patent [19]

Tanaka

[11] Patent Number: 6,016,784

[45] Date of Patent: Jan. 25, 2000

[54] OIL FILTER ATTACHING STRUCTURE FOR ENGINE

[75] Inventor: Ryuji Tanaka, Shizuoka-ken, Japan

[73] Assignee: Suzuki Motor Corporation, Shizuoka-ken, Japan

[21] Appl. No.: 09/014,510

[22] Filed: Jan. 28, 1998

[30] Foreign Application Priority Data

Jan. 31, 1997 [JP] Japan ..... 9-032887

[51] Int. Cl.[7] ..... F01M 1/00

[52] U.S. Cl. ..... 123/196 R; 123/196 S; 123/196 AB; 123/196 A; 184/6.24

[58] Field of Search ..... 123/196 R, 196 A, 123/196 S, 196 AB; 184/6.24, 104.3

[56] References Cited

U.S. PATENT DOCUMENTS

| | | | |
|---|---|---|---|
| 4,174,699 | 11/1979 | Gill | 123/196 S |
| 4,538,565 | 9/1985 | Hiolaka et al. | 123/198 R |
| 4,662,328 | 5/1987 | Kromch | 123/198 C |
| 5,032,259 | 7/1991 | He et al. | 210/133 |

*Primary Examiner*—Noah P. Kamen
*Assistant Examiner*—Hai Huynh
*Attorney, Agent, or Firm*—Flynn, Thiel, Boutell & Tanis, P.C.

[57] ABSTRACT

An oil filter attaching structure for an engine has a stand hole communicated with a main oil gallery formed in a lower casing of an engine. The stand hole is formed therein with either one of two different length female threads, one length female thread part is for use without an oil cooler and the other length female thread part is for use with an oil cooler. A filter stand is formed having one end with a male thread part for use without an oil cooler, with a length which is longer than that of the one female thread part. The filter stand is formed with a male thread part on the other end for use with an oil cooler, having a length which is longer than that of the other female thread part. The filter stand has one end screwed into the stand hole. The other end of the filter stand has an oil filter attached. The same filter stand can be used on engines with or without an oil cooler. The filter structure allows visible confirmation of proper assembly.

6 Claims, 5 Drawing Sheets

OIL FILTER ATTACHING STRUCTURE FOR ENGINE

FIELD OF THE INVENTION

The present invention relates to an oil filter attaching structure for an engine, and in particular, to an oil filter attaching structure in which correct assembly can readily be confirmed during assembly of a filter stand so as to prevent the filter stand from being improperly assembled and, even when it is improperly assembled, an oil passage is formed so as to allow oil to flow and prevent seizure of the engine.

BACKGROUND OF THE INVENTION

An engine circulates oil for lubricating and cooling several parts thereof. The oil is stored in an oil pan and is fed into an oil subgallery by an oil pump. The oil in the oil subgallery is fed through an oil filter so as to remove foreign matter, and thereafter is fed into an oil main gallery in order to lubricate and cool parts of the engine.

FIG. 7 shows such a conventional oil filter attaching structure for an engine without an oil cooler. Arrows in FIG. 7 indicate the direction of oil flow.

Referring to FIG. 7, there is shown part of a lower casing 202 for an engine without an oil cooler. This lower casing 202 is provided with a casing-side journal member 204 for journalling a crankshaft (not shown) in cooperation with a block-side journal part (not shown). Each end of the casing-side journal member 204, which extends in a direction transverse to a crankshaft axis A, is coupled to a casing-side coupling member 206.

In the lower casing 202, the casing-side coupling member 206 is formed with a subgallery 208 into which oil is fed from an oil pump (not shown), and is also formed with a main gallery 210 for feeding filtered oil from 35 which particulates are removed, into various parts of the engine.

The coupling member 206 of the lower casing 202 is formed with a stand hole 212 which communicates with the main gallery 210. The stand hole 212 for engines without an oil cooler, is formed with a female thread part 214 having a length extending upwardly beyond the main gallery 210. A filter stand 216 for use on engines without an oil cooler is provided. A male thread part 218 is provided at one end of the filter stand 216. The male thread part 218 is screwed into the female thread part 214 of the hole 212. The male thread part 218 has a longitudinal length which is set so as to prevent the main gallery 210 from being blocked.

The filter stand 216 as screwed in the stand hole 212 has a filter male thread part 222 which is provided on the other end thereof, and onto which an oil filter 224 is screwed. An intermediate non-thread part 220 is located on filter stand 216 between the male thread parts 218 and 222. The oil filter 224 communicates with the subgallery 208 through a filter introduction hole 226 formed in the casing 202, and also communicates with the stand hole 212 through a stand oil passage 228 which extends through the stand 216 so as to allow oil to flow from the oil filter into the main gallery 210.

Referring now to FIG. 8, a conventional oil filter attaching structure for an engine with an oil cooler is shown. Arrows in FIG. 8 indicate the direction of oil flow. In FIG. 8, a casing-side journal member 304 is formed in lower casing 302 and a coupling member 306 is formed with a stand hole 312 which communicates with a main gallery 310. This stand hole 312 is formed with a female thread part 314 having a length extending upwardly beyond the main gallery 310. A filter stand 316 for use on engines with an oil cooler is provided. A male thread part 318 is located on one end of the filter stand 316 and screws into the female thread part 314. The male thread part 318 has a longitudinal length which is set so that it blocks the main gallery 310 to prevent direct communication with the stand hole 312.

The filter stand 316 when screwed in the stand hole 312 has the male thread part 318 blocking the main gallery 310, and a filter male thread part 322 which is provided on the other end. An intermediate non-thread part 320 is located between the male thread parts 318 and 322. The filter male thread part 322 has screwed thereon an oil filter 324. The oil filter 324 communicates with a subgallery 308 through a filter introduction hole 326, and also communicates with the stand hole 312 through a stand oil passage 328 in the filter stand 316.

Further, in the lower casing 302, the casing-side coupling member 306 is formed with a cooler bolt hole 330 communicating with the main gallery 310 and inclined with respect to the stand hole 312. The cooler bolt hole 330 has formed therein a cooler female thread part 332. A bolt male thread part 336 of a cooler bolt 334 is screwed into the cooler female thread part 332. Thereby, oil cooler 338 is mounted to the coupling member 306.

The oil cooler 338 communicates with the stand hole 312 through a cooler introduction hole 340 formed in the casing 302, and communicates with the main gallery 310 through a bolt oil passage 342 formed in the cooler bolt 334.

The male thread part 318 has a length which is set so that it blocks the main gallery 310, and accordingly, oil having passed through the oil filter 324 flows through the oil cooler 334 without flowing directly into the main gallery 310.

The stand hole 212 in the conventional lower casing 202 of FIG. 7 is formed with the female thread part 214 having a length extending beyond the main gallery 210. Similarly, the female thread part 314 in the stand hole 312 of the conventional lower casing 302 of FIG. 8 is also formed with the female thread part 314 having a length extending beyond the main gallery 310.

Referring to FIG. 9, a possible engine assembly line problem is illustrated if the wrong filter stand is selected during engine assembly. In FIG. 9 the male thread part 318 of the filter stand 316 (for use with an oil cooler) is screwed, in error, into the female thread part 214 of the lower casing 202 (for use without an oil cooler), causing a defective assembly. In the case of this defective assembly, the male thread part 318, due to its length, blocks the main gallery 210, and accordingly oil cannot flow into the main gallery 210, causing possible engine damage or seizure. In FIG. 9, it can be sen that after the improper assembly, the only part of filter stand 316 that is visible is the thread part 322 and the non-thread part 320. Visually, this is substantially identical to the proper assemblies shown in FIGS. 7 and 8, and thus it is not possible to visually discriminate between a correct and an incorrect assembly.

SUMMARY OF THE INVENTION

In order to eliminate the above-mentioned disadvantages, this invention relates to an oil filter attaching structure for an engine having a lower casing attached to a cylinder block and journalling a crankshaft, a stand hole is formed in the lower casing and communicates with a main oil gallery, a filter stand is threadedly attached at one end in the stand hole, and an oil filter is threadedly attached to the other end of the filter stand. The stand hole is formed with either a female thread part for use without an oil cooler or a female thread part for use with an oil cooler, the female thread parts having different lengths. The filter stand has on one end a male thread part for use without an oil cooler and having a length longer than that of the female thread part for use without an oil cooler, and on the other end a male thread part for use with an oil cooler and having a length longer than that of the female thread part for use with an oil cooler. The above-mentioned filter stand is formed with an intermediate non-thread part. Accordingly, should the male thread part for use with an oil cooler be screwed, in error, into the female thread part for use without an oil cooler, the male thread part cannot be completely screwed into the improper female thread part so as to leave some of the male threads exposed.

If the male thread part for use without an oil cooler is screwed, in error, into the female thread part of the stand hole for use with an oil cooler, the male thread part can be completely screwed into the female thread part. It is thereby possible to visually check for an improper assembly.

Further, in the oil filter attaching structure for an engine according to the present invention, in the lower casing, the stand hole is formed therein with either one of the female thread part for non-presence of a cooler or the female thread part for presence of a cooler, which thread parts have different lengths. With this arrangement, for example, the female thread part for use without an oil cooler has a length which extends to the main gallery, and accordingly even if the male thread part for use with an oil cooler on the filter stand is erroneously screwed into the female thread part for use without an oil cooler, the main gallery is not blocked by the male thread part, and thus allows oil to flow into the main gallery.

Further, the filter stand is formed with the male thread part for non-presence of a cooler on one axial end, and is formed with the male thread part for presence of a cooler on the other axial end, with the intermediate non-thread part positioned therebetween. This allows the same filter stand to be used for both engines with oil coolers and engines without oil coolers.

DETAILED DESCRIPTION

Explanation will now be made of an embodiment of the present invention with reference to FIGS. 1 to 6.

Figure 5:
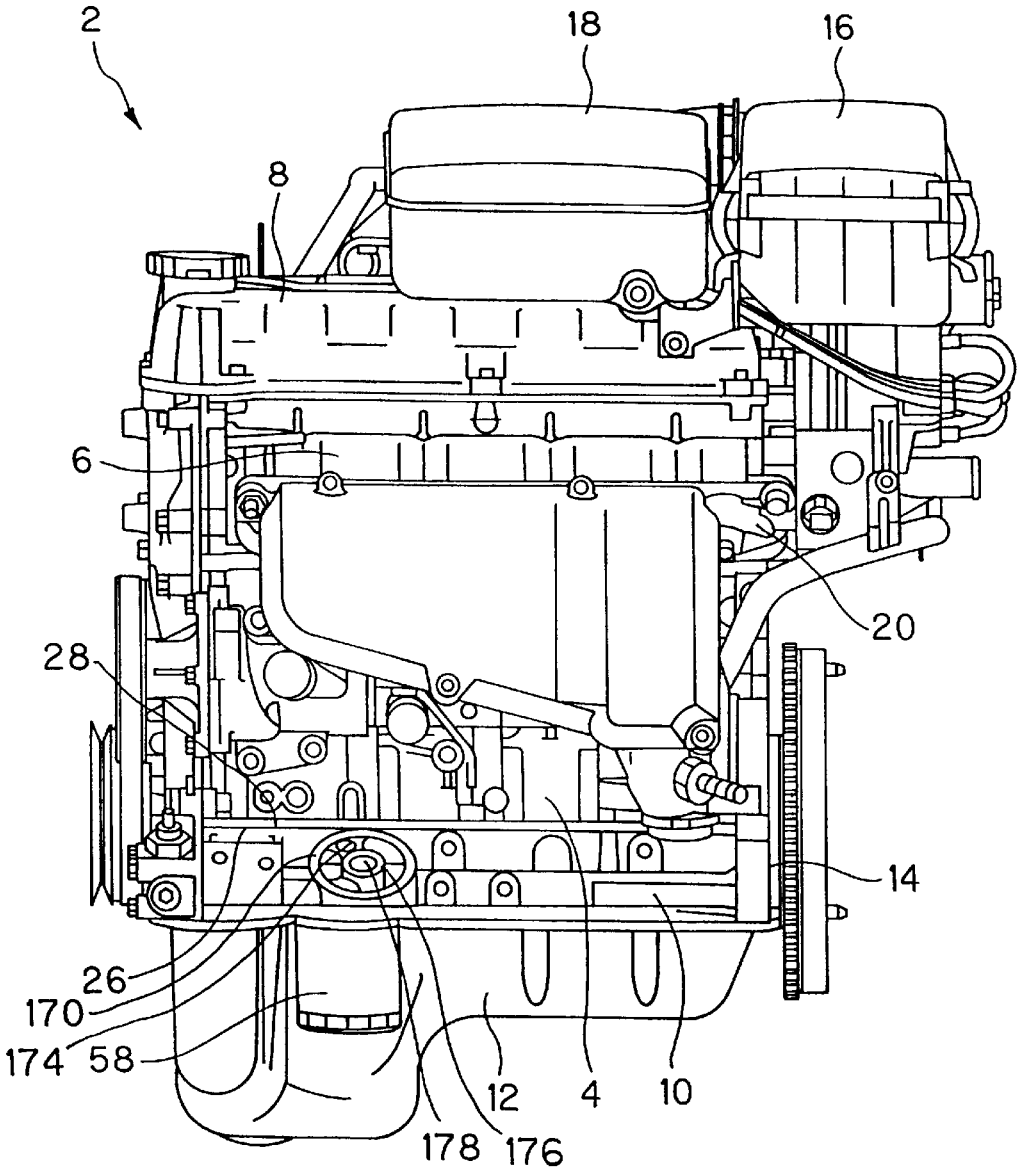
FIG. 5 is a side view illustrating an engine incorporating the lower casing with an oil cooler, but having the oil cooler removed for clarity of illustration.

Referring to FIG. 5, there is shown an engine 2 which includes a cylinder block 4, a cylinder head 6, a head cover 8, a lower casing 10 without an oil cooler, and an oil pan 12. In the engine 2, the cylinder head 6 is attached to the upper part of the cylinder block 4, and the head cover 8 is attached to the cylinder head 6. The lower casing 10 is attached to the lower part of cylinder block 4 so as to journal a crankshaft 14 therebetween, and the oil pan 12 is attached to the lower casing 10. Reference numeral 16 denotes an air cleaner, 18 denotes a resonator, and 20 denotes an exhaust manifold.

Figure 1:
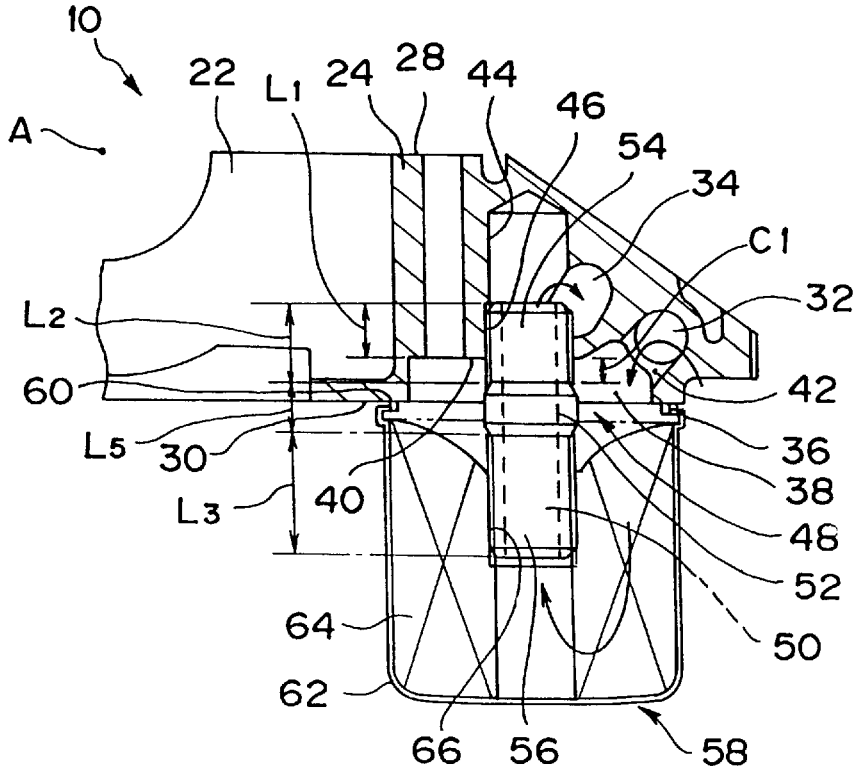
FIG. 1 is an enlarged sectional view illustrating part of a lower casing without an oil cooler and showing an oil filter attaching structure according to the present invention.
Figure 2:
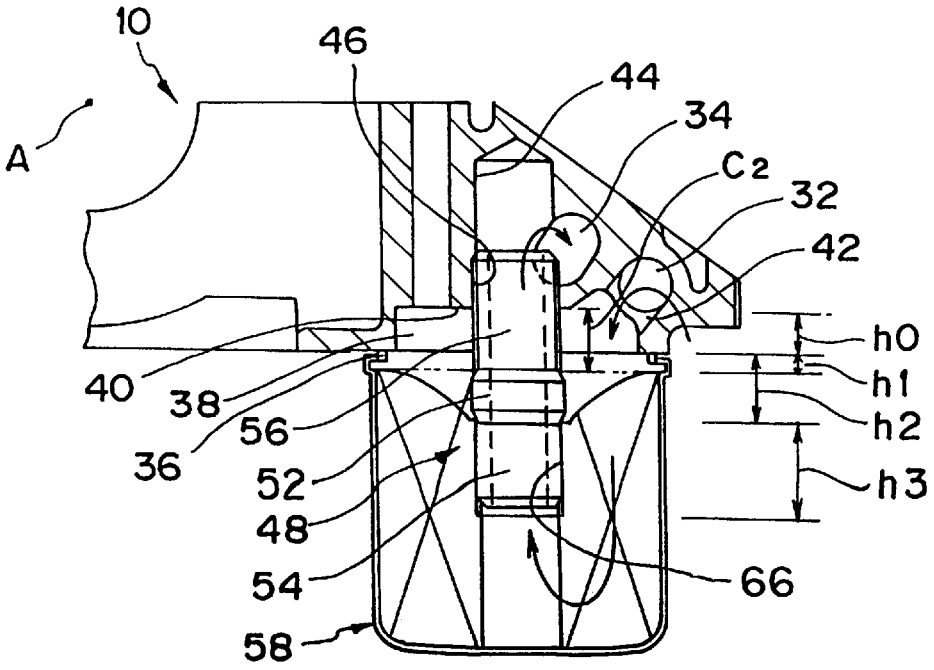
FIG. 2 shows the oil filter structure of FIG. 1 with the filter stand reversed.

In the lower casing 10 without an oil cooler as shown in FIGS. 1 and 2, a casing-side journalling member 22 journals the crankshaft 14 in cooperation with the block-side journalling member (not shown) of the cylinder block 4. Several such journalling members 22 are provided in parallel (not shown) with each other and extend in a direction perpendicular to the crankshaft axis A. The casing-side journalling member 22 is coupled at its ends to a casing-side coupling member 24.

The cylinder block 4 is formed at its lower side with a lower casing attaching surface 26 (FIG. 5). A block attaching surface 28 adapted to abut against the lower casing attaching surface 26 is formed at the upper side of the lower casing 10, and a pan attaching surface 30 (FIG. 1) adapted for attachment to the oil pan 12 is formed at the lower side of casing 10.

The casing-side coupling member 24 is formed with a subgallery 32 into which oil is fed from an oil pump (not shown). Coupling member 24 also is formed with a main gallery 34 for feeding filtered oil into various parts of the engine.

A ring-like filter attaching seat 36 is formed on the pan attaching surface 30 side of the casing-side coupling member 24. A filter introduction port 38 is recessed in the filter attaching seat 36. A filter introduction hole 42 is formed on one side of the peripheral edge of the bottom surface 40 of the filter introduction port 38 for communication with the subgallery 32.

A stand hole 44 communicating with the main gallery 34 is formed in the center of the bottom surface 40 of the filter introduction port 38. The stand hole 44 is formed with a female thread part 46 which has a length L1 which extends from the bottom surface 40 to the main gallery 34.

The female thread part 46 in the stand hole 44 has screwed therein a tubular filter stand 48 having male threads commonly used in engines both with oil coolers and without oil coolers. The filter stand 48 is formed in a substantially hollow cylindrical shape having a stand oil passage 50 extending therethrough in the longitudinal direction thereof, and is formed with an exterior male thread part 54 on one end. The male thread part 54 is used in hole 40 on engines without an oil cooler. The filter stand 48 has an intermediate non-thread part 52, and is formed with an exterior male thread part 56 on the other end thereof. The male thread part 56 is used in hole 40 on engines with an oil cooler. Male thread parts 54 and 56 are formed as male threads of equal diameter and equal pitch and thread in the same direction.

The male thread part 54 of the filter stand 48, as shown in FIG. 1, has an axial length L2 which is longer than the axial length L1 of the female thread part 46 so that an axial clearance C1 is defined between the bottom surface 40 and the non-thread part 52. This results in the main gallery 34 not being blocked when the male part 54 is screwed into the stand hole.

The oil filter 58 is screwed onto the male part 56 in the filter stand 48. The oil filter 58 is composed of a filter casing 62 formed with a filter attaching surface 60 adapted to abut against the filter attaching seat 36. The filter element 64 is incorporated into the filter casing 62. A filter side female thread part 66 is located inward from the filter attaching surface 60 and positioned at the center of the filter element 64. The filter side female thread part 66 has a female thread having a diameter and pitch which are equal to those of the male thread parts 54 and 56, and is formed in a thread direction the same as that of the male thread parts 54 and 56. Further, the filter side female thread part 66 has a length which is longer than the length L3 of the male thread part 56.

The oil filter 58 communicates with the subgallery 32 through the filter introduction hole 42, and communicates with the stand hole 44 through the stand oil passage 50 in the filter stand 48 so as to allow filtered oil from which particulates are removed to flow into the main gallery 34.

Figure 6:
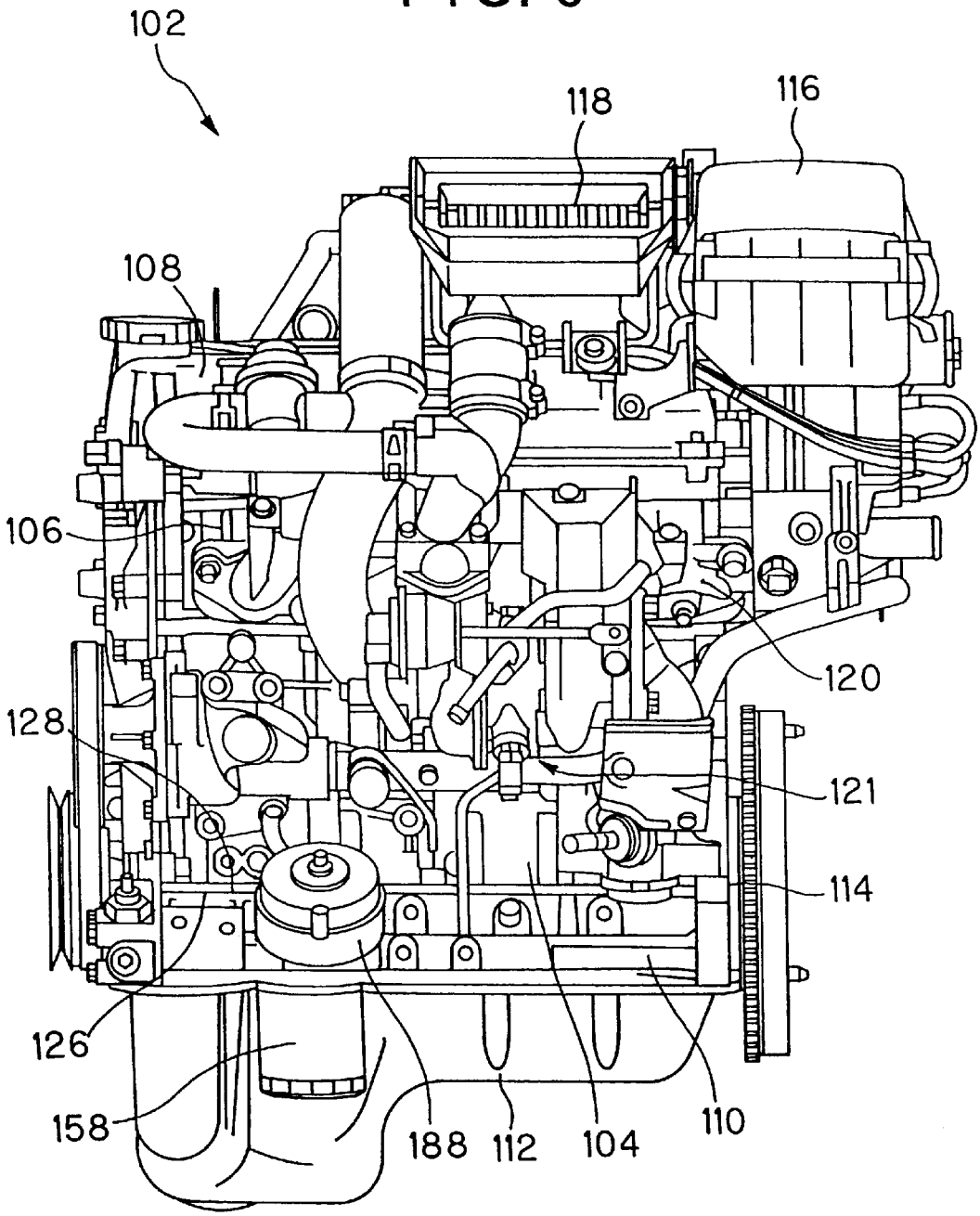
FIG. 6 shows the engine of FIG. 5 with the oil cooler attached.
Figure 7:
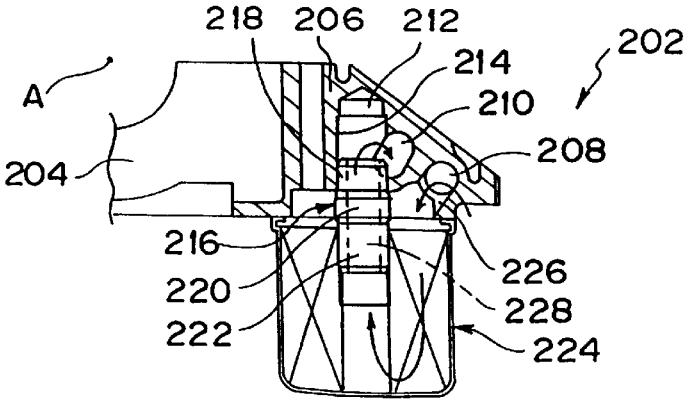
FIG. 7 PRIOR ART
FIG. 7 is an enlarged sectional view illustrating a conventional prior art lower casing without an oil cooler.
Figure 8:
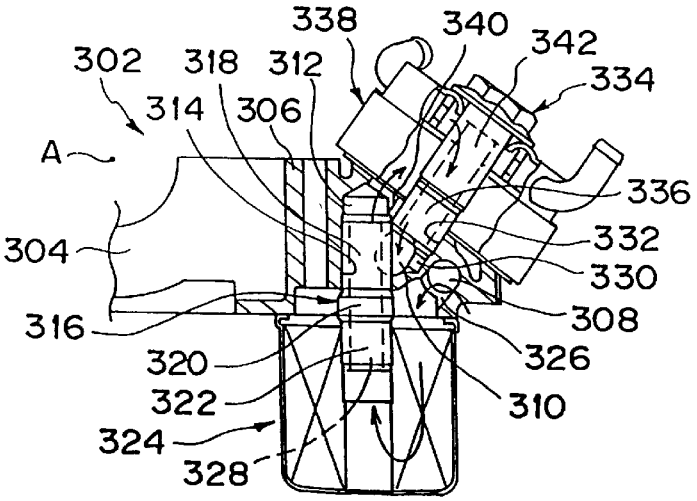
FIG. 8 PRIOR ART
FIG. 8 is an enlarged sectional view illustrating a conventional prior art lower casing with an oil cooler.
Figure 9:
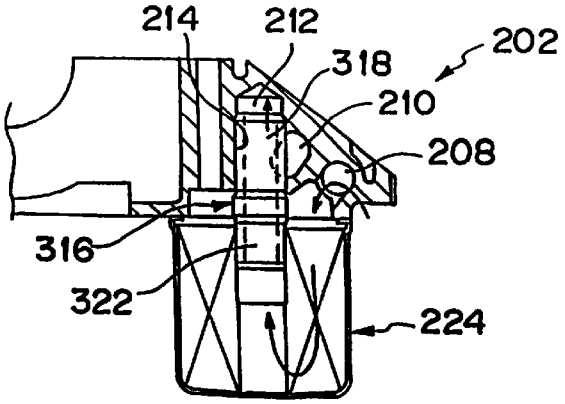
FIG. 9 PRIOR ART
FIG. 9 shows the lower casing of FIG. 7 with the filter stand of FIG. 8 improperly mounted thereon.

Referring now to FIG. 6 there is shown an engine 102 similar to FIG. 5, includes a cylinder head 106 attached to an upper part of a cylinder block 104, a head cover 108 attached to the cylinder head 106, a lower casing 110 for use with an oil cooler attached to the lower part of the cylinder block 104 so as to journal a crankshaft 114 therebetween, and an oil pan 112 attached to the lower casing 110. Reference numeral 116 denotes an aircleaner, 118 denotes an intercooler, 120 denotes an exhaust manifold, and 121 denotes a supercharger.

Figure 3:
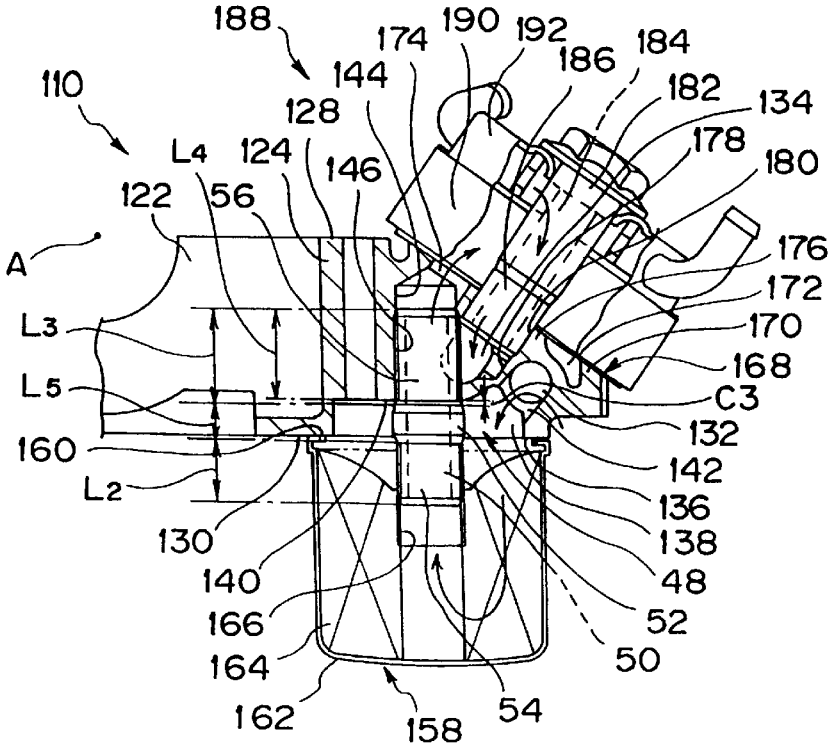
FIG. 3 is an enlarged sectional view illustrating part of the lower casing with an oil cooler and showing the oil filter attaching structure of the present invention.
Figure 4:
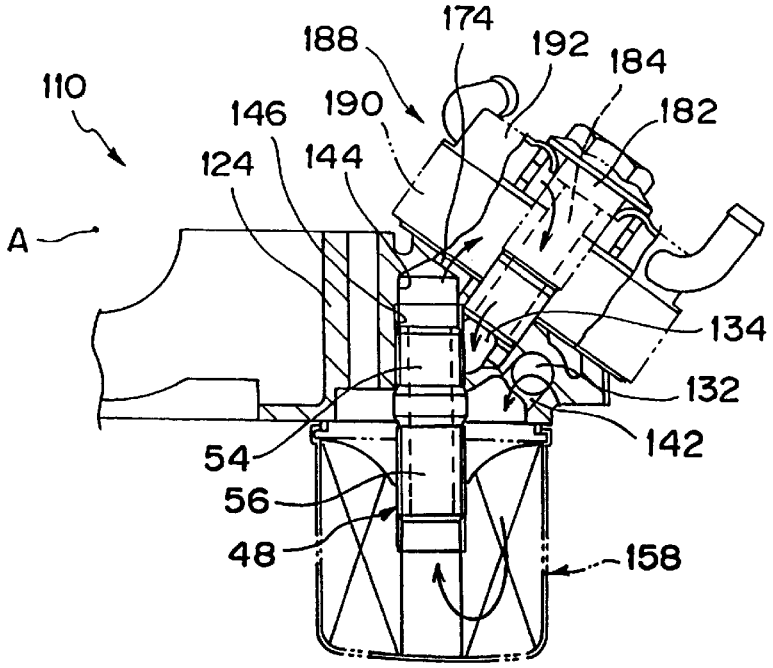
FIG. 4 shows the oil filter structure of FIG. 3 with the filter stand reversed.

In the lower casing 110 for use with an oil cooler, as shown in FIGS. 3 and 4, a casing-side journalling member 122 journals the crankshaft 114 in cooperation with a block-side journalling part (not shown) of the cylinder block 104, several such members being provided in parallel and extending in a direction crossing the crankshaft axis A. The casing-side journalling member 122 has its ends each coupled by a casing-side coupling member 124.

The cylinder block 104 is formed at its lower side with a lower casing attaching surface 126 (FIG. 6). A block attaching surface 128 adapted to abut against the lower casing attaching surface 126 is formed at the upper side of the lower casing 110, and a pan attaching surface 130 to which an oil pan 112 is attached is formed at the lower side of the lower casing 110.

The casing-side coupling member 124 is formed with a subgallery 132 in which oil is fed from an oil pump (not shown). Coupling member 124 also is formed with a main gallery 134 for feeding filtered oil into various parts of the engine.

A ring-like filter attaching seat 136 is formed on the casing-side coupling member 124 on the side of the pan attaching surface 130. A cylindrical filter introduction port or chamber 138 is recessed in the filter attaching seat 136. A filter introduction hole 142 is formed on one side of the peripheral edge of the bottom surface 140 of the filter introduction chamber 138 for communication with the subgallery 132.

A stand hole 144 which communicates with the main gallery 134 is formed in the center of the bottom surface 140 of the filter introduction chamber 138. The stand hole 144 is formed with a female thread part 146 for use with an oil cooler. The female thread part 146 has an axial length L4 extending from the bottom surface 140 upwardly beyond the main gallery 134.

The female thread part 146 has screwed therein the tubular filter stand 48 which is commonly used for both engines with oil cooler and without oil coolers. The filter stand 48, as described above relative to FIGS. 1 and 2, is formed in a substantially hollow cylindrical shape, having the filter oil passage 50 formed therethrough in the longitudinal direction thereof, is formed with the male thread parts 54 and 56 on opposites ends, and has an intermediate non-thread part 52 located between the thread parts 54 and 46. These male thread parts 54 and 56 are formed as described above.

The male thread part 56 of the filter stand 48, as shown in FIG. 3, has an axial length L3 which is greater than the axial length L4 of the female thread part 146 for use with an oil cooler so that the part 56 blocks the main gallery 134, and a small axial clearance C3 is defined between the introduction port bottom surface 140 and the upper shoulder of the non-thread part 52 when it is screwed into the female thread part 146.

Referring to FIG. 4, the filter stand 48 is shown reversed so that the thread part 54, which is normally for use on an engine without an oil cooler, is screwed into the thread part 146. The male thread part 54 has a length L2 which is shorter than the length L4 (FIG. 3) of the female thread part 146, so that no clearance is defined between the introduction port bottom surface 140 and the non-thread part 52 when the part 54 is screwed into the female thread part 146 which is intended for use with an oil cooler.

As shown in FIG. 3, an oil filter 158 is screwed onto the male thread part 54 when the male thread part 56 is screwed in the female thread part 146 for cooperation with an oil cooler. The oil filter 158 is composed of a filter casing 162 adapted to abut against the filter attaching seat 136, a filter element 164 incorporated in the filter casing 162, and a filter side female thread part 166 extending inwardly from a filter attaching end surface 160 and positioned at the center of the filter element 164. The filter side female thread part 166 has a thread having a diameter and pitch which equals those of the male thread parts 54 and 56, and extending in the same thread direction.

The oil filter 158 has the filter side thread part 166 screwed on the male thread part 54 for use without an oil cooler, is made at its filter attaching surface 160 to contact with the filter attaching seat 136, is communicated with the subgallery 132 through the filter introduction hole 142, and is communicated with the stand hole 144 through the stand oil passage 50 in the filter oil stand 48 so as to allow filtered oil from which particulates are removed to flow into the main gallery 134.

Further, the casing-side coupling member 124 in the lower casing 110 is formed with a casing-side inclined surface 168 which is inclined downward and outward so as to extend from a side of the block attaching surface 128, near to the crankshaft axis A, to a side of the pan attaching surface 130, remote from the crankshaft axis A. The inclined surface 168 is formed with a ring-like cooler attaching seat 170. A groove-like ring on the cooler introduction part 172 is recessed in the cooler attaching seat 170, and a cooler introduction hole 174 communicating with the inward end of the stand hole 144 is formed in the cooler introduction part 172.

A cooler boss part 176 is formed at the center of the cooler introduction part 172, and a cooler bolt hole 178 communicating with the main gallery 134 is formed in the cooler boss part 176. The cooler bolt hole 178 is communicated with the main gallery 134, and the axis thereof being offset from the axis of the stand hole 144. The cooler bolt hole 178 is formed therein with a female thread part 180. A bolt 182 is screwed into the female thread part 180 of the cooler bolt hole 178. The bolt 182 is formed to have an oil hole 184 extending from its front end to its outer periphery in the vicinity of its rear end, and is formed with a male thread part 186.

The bolt 182 is attached to an oil cooler 188. The oil cooler 188 is composed of a ring-like cylindrical oil flowing part 190, and a cooling water flowing part 192. The oil cooler 188 is attached by fitting the bolt 182 in the oil flowing part 190 and the cooling water flowing part 192, and by screwing the bolt male thread part 186 into the female thread part 180.

When the oil cooler 188 attached by the cooler bolt 182, the oil flowing part 190 is brought into contact with the cooler attaching seat 170, and is communicated with the stand hole 144 through the cooler introduction hole 174, and also is communicated with the main gallery 134 through the oil passage 184 in the bolt 182. Thus, oil flowing through the oil flowing part 190 is cooled through heat-exchange between the oil and cooling water flowing through the cooling water flowing part 194.

Next, the use of the present invention will be explained in conjunction with the incorrect assembly of an engine without an oil cooler.

As shown in FIG. 1, when the oil filter 58 is attached to the lower casing 10 without an oil cooler, the male thread part 54 (for use without an oil cooler) having the length L2 on the filter stand 48 is screwed into the female thread part 46 (for use without an oil cooler) having the length L1 in the stand hole 44. In this case, when the filter stand 48 is properly assembled, the clearance C1 is defined between the bottom surface 40 and the non-thread part 52 of the filter stand 48.

In contrast, in the case of an improper assembly of the filter stand 48 in which the male thread part 56 (for use with an oil cooler) having the length L3 on the filter stand 48 is screwed into the female thread part 46 having the length L1 in the stand hole 44, as shown in FIG. 2, a clearance C2 is defined between the bottom surface 40 and the non-thread part 52 of the filter stand 48. Accordingly, in such case that the male thread part 56 is screwed, in error, into the female thread part 46, it extends from the bottom surface to an amount corresponding to the clearance C2 which is greater than the clearance C1. This allows an assembly worker to easily see a defective assembly.

Thus, after the filter stand 48 is assembled, whether it is properly assembled or not can be easily confirmed by the worker in view of the clearance C1 or C2 as shown in FIGS. 1 and 2.

Further, since the female thread part 46 for use without an oil cooler has a length L1 by which it extends to an intermediate part of the main gallery 34, even when the male thread part 56 is screwed in error into the female thread part 46 as shown in FIG. 2, the main gallery 34 is not blocked by the male thread part 56 and proper oil flow into the main gallery 34 is maintained.

Accordingly, with this oil filter attaching structure, whether the assembly is properly made or not can be confirmed during assembly of the filter stand 48, and the flow of oil into the main gallery 34 can be ensured even in the case of improper assembly. Thus, it is possible to prevent seizure of the engine 2 even though improper assembly is made. Further, in the oil filter 58, the filter side female thread part 66 is located inward from the filter attaching surface 60 and has a length longer than that of the male thread part 56 which allows the filter 58 to be attached even when the filter stand 48 is improperly assembled.

Referring to FIGS. 3 and 4, the assembly of the stand 48 on an engine with an oil cooler will be discussed.

As shown in FIG. 3, when the oil filter 158 is attached to the lower casing 110, the male thread part 56 (for use with an oil cooler) having the length L3 on the filter stand 48 is screwed into the female thread part 146 of length L4. When the filter stand 48 is properly assembled, the small clearance C3 is defined between the bottom surface 140 and the non-thread part 52 of the filter stand 40.

In contrast, as shown in FIG. 4, in the case of an improper assembly of the filter stand 48 in which the male thread part 54 (for use without an oil cooler) having a length L2 (FIG. 3) is screwed into the female thread part 146 having a length L4, no clearance is defined between the bottom surface 140 and the non-thread part 52 of the filter stand 48.

Thus, when the male thread part 54 is screwed in error into the female thread part 148, the male thread part 54 can be completely screwed into the female thread part 146 so that no clearance is defined, and accordingly it is possible to easily and visually detect the improper assembly.

Thus, the filter stand 48 can be used on engines with an oil cooler and can also be used on engines without an oil cooler.

In the oil filter attaching structure, the same filter stand 48 can be used in common for both the lower casing 10 without an oil cooler and the lower casing 110 with an oil cooler, and further the same oil filter can be commonly used, thereby eliminating improper assembly.

It is noted that, as shown in FIGS. 1 and 2, the length L1 of the female thread part 46, the length L5 of the non-thread part 52, the length L2 of the male thread part 54, and the length L3 of the male thread part 56 are set so that h0 is a height from the bottom surface 40 of the lower casing 10 to the filter attaching seat 36, h1 is a height from the filter attaching seat 36 to the non-thread part 52 of the filter stand 48 when the male thread part 56 (for use with an oil cooler) is screwed into the female thread part 46 (for use without an oil cooler), h2 is a height (relief) from the filter attaching seat 36 to the upper end of the filter side female thread part 66, and h3 is a height from the upper opening end of the filter female thread part 66 to the lower end thereof.

The oil filter can be attached to casing 10 without blocking the main gallery 34 even though either of the male thread parts 54 or 56 are screwed into the female thread part 46. This eliminates the possibility of an improper assembly and allows the same common filter stand 48 to be used for both the lower casing 10 with an oil cooler and the lower casing 110 without an oil cooler.

As mentioned above, in the oil filter attaching structure of an engine, according to the present invention, in the case that the one male thread part for use with an oil cooler is improperly screwed and assembled to the female thread part of a casing which does not use a cooler, the one male thread part does not completely screw in the female thread part, but is projected therefrom. Alternatively, in the case that the other male thread part for non-use with an oil cooler is improperly screwed and assembled in the female thread part of a casing having a cooler, the other male thread part screws completely into the female thread part, and it is thereby possible to visually detect an improper assembly of the filter stand.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. An oil filter attaching structure for an engine without an oil coolers, comprising:

a lower case attached to a cylinder block, said lower case defining therein a stand hole having a longitudinal axis and a main oil gallery in communication therewith, said stand hole opening generally downwardly through a bottom side of said lower case and having a female thread part formed therein; and an elongate tubular filter stand having a first threaded male end part for mounting within said stand hole and a second threaded male end part for mounting thereon an oil filter, said first and second end parts having different axial lengths, said female thread part extending from said bottom side to a termination point which is axially adjacent said main gallery but short of a location which would permit either of said male end parts, when threadingly engaged with said female thread part, to block said main gallery such that oil is allowed to flow from said oil filter and into said main gallery regardless of the axial orientation of the filter stand in said stand hole.

2. The attaching structure according to claim 1, wherein said filter stand has a non-threaded intermediate part disposed between said first and second male end parts and the axial length of the female thread part is less than the axial length of said first and second male end parts so that when said first male end part is screwed into said stand hole said intermediate part is spaced a first distance below said bottom side of said lower case and is visually recognizable, and wherein when said second male end part is screwed into said stand hole said intermediate part is spaced a second distance below said bottom side of said lower case, said second distance being greater than said first distance such that the incorrect assembly of said second male end part in said stand hole is visually recognizable.

3. An oil filter attaching structure for an engine having an oil cooler, comprising:

a lower case attached to a cylinder block, said lower case defining therein a stand hole having a longitudinal axis and communicating with a main oil gallery defined within said lower case and an oil cooler introduction hole in communication with, said oil cooler, said stand hole opening downwardly through a bottom side of said lower case and having a female thread part formed therein and extending from a bottom side of said lower case to a point located between said main oil gallery and said introduction hole, said main oil gallery being disposed between said introduction hole and said bottom side of said stand hole;

a filter stand having opposite first and second threaded male end parts of different first and second axial lengths respectively, said first length being greater than said second length, and a non-threaded intermediate part located between said first and second male end parts; and said female thread part having an axial length which is less than said first length of said first male end part but greater than said second length of said second male end part so that when said first male end part is screwed into said female thread part said non-threaded intermediate part is spaced downwardly a small distance below the bottom side of said lower case and is visually recognizable, and when said second end part is screwed into said female thread part said non-threaded intermediate part lies closely adjacent said bottom side and is visually recognizable.

4. The attaching structure according to claim 3 wherein said female thread part extends axially from said bottom side upwardly beyond said main gallery and said first male end part blocks said main gallery opening when threadingly engaged within said stand hole to block the flow of oil into said main gallery.

5. An oil filter attaching structure for an engine having a cylinder block, said attaching structure comprising:

a lower case for attachment to the cylinder block, said lower case defining therein a stand hole having a longitudinal axis and opening generally downwardly through a bottom side of said lower case, and a main oil gallery spaced-apart from said bottom side and in communication with said stand hole, said stand hole having a female thread part terminating at said main gallery when said attaching structure is not provided with an oil cooler and extending beyond said main gallery when said attaching structure is provided with an oil cooler; and an elongate tubular filter stand having axially spaced first and second threaded male end parts of different axial lengths, one of said end parts for mounting within said stand hole and the other of said end parts for mounting an oil filter thereon, said first male end part having an axial length greater than an axial length of said second male end part, said first male end part, when threadingly engaged within said female thread part which terminates beyond said main gallery, extending beyond and blocking said main gallery to direct oil into the oil cooler, and said first and second male end parts, when threadingly engaged within said female thread part which terminates at said main gallery, terminating at said main gallery to allow oil to flow into said main gallery.

6. The attaching structure according to claim 5 wherein said filter stand includes a non-threaded enlarged intermediate part disposed between said first and second male end parts, said intermediate part being spaced apart from said bottom side when said first male end part is threadingly engaged within said female thread part which terminates at said main gallery.

* * * * *

UNITED STATES PATENT AND TRADEMARK OFFICE
CERTIFICATE OF CORRECTION

PATENT NO : 6 016 784
DATED : January 25, 2000
INVENTOR(S) : Ryuji TANAKA

It is certified that error appears in the above-identified patent and that said Letters Patent are hereby corrected as shown below:

| | | |
|---|---|---|
| Column 8; | line 65, | change "coolers" to ---cooler---. |
| Column 9; | line 38, | after "with" delete ---,---. |

Signed and Sealed this

Third Day of April, 2001

*Attest:*

Nicholas P. Godici

NICHOLAS P. GODICI

*Attesting Officer*

*Acting Director of the United States Patent and Trademark Office*